US008186105B2

(12) United States Patent
Jackson et al.

(10) Patent No.: US 8,186,105 B2
(45) Date of Patent: May 29, 2012

(54) RETRACTABLE LOAD-BEARING COVER

(75) Inventors: Judd Jackson, Grant, MN (US); Scott Uram, Wyoming, MN (US); Brian Weisner, Hugo, MN (US); Lee Debeau, Marine on St. Croix, MN (US)

(73) Assignee: Wutpol, Inc., Blaine, MN (US)

( * ) Notice: Subject to any disclaimer, the term of this patent is extended or adjusted under 35 U.S.C. 154(b) by 425 days.

(21) Appl. No.: 12/335,342

(22) Filed: Dec. 15, 2008

(65) Prior Publication Data

US 2009/0217599 A1 Sep. 3, 2009

(51) Int. Cl.
*B62D 63/04* (2006.01)
*E04B 1/34* (2006.01)

(52) U.S. Cl. ..... 52/3; 52/5

(58) Field of Classification Search ..... 52/3, 5, 52/342, 66, 71; 312/9.31; 414/22.66; 74/10.85
See application file for complete search history.

(56) References Cited

U.S. PATENT DOCUMENTS

| | | | | | |
|---|---|---|---|---|---|
| 1,913,342 | A | * | 6/1933 | Schaffert | 52/588.1 |
| 3,466,830 | A | * | 9/1969 | Smith | 52/777 |
| 4,068,699 | A | * | 1/1978 | Tucker | 160/33 |
| 4,120,133 | A | * | 10/1978 | Rodgers et al. | 52/745.02 |
| 4,373,404 | A | * | 2/1983 | Heinz | 74/89.25 |
| 4,379,478 | A | * | 4/1983 | Lichy | 160/35 |
| 4,500,071 | A | * | 2/1985 | Bagwell et al. | 254/423 |
| 4,501,949 | A | * | 2/1985 | Antol et al. | 219/121.63 |
| 4,550,945 | A | * | 11/1985 | Englehardt | 296/100.09 |
| 4,616,451 | A | * | 10/1986 | Glick | 52/66 |
| 4,628,646 | A | * | 12/1986 | Eyerle | 52/71 |
| 4,662,420 | A | * | 5/1987 | Hirao | 160/32 |
| 4,762,242 | A | * | 8/1988 | Harris et al. | 220/484 |
| 5,133,398 | A | * | 7/1992 | Yang et al. | 160/33 |
| 5,238,351 | A | * | 8/1993 | Lichti et al. | 414/331.03 |
| 5,319,905 | A | * | 6/1994 | Szirtes | 52/108 |
| 6,003,920 | A | * | 12/1999 | Crisp | 296/37.1 |
| 6,088,963 | A | * | 7/2000 | Cawthon et al. | 49/33 |
| 6,202,355 | B1 | * | 3/2001 | Uram et al. | 52/5 |
| 6,339,905 | B1 | * | 1/2002 | Craig | 52/174 |
| 6,851,227 | B1 | * | 2/2005 | Schildge, Jr. | 52/66 |
| 6,942,286 | B2 | * | 9/2005 | Bohm et al. | 296/216.05 |
| 2002/0144340 | A1 | * | 10/2002 | Last | 4/502 |
| 2008/0016611 | A1 | | 1/2008 | Khalaf et al. | |

FOREIGN PATENT DOCUMENTS

NL 2000452 1/2007

* cited by examiner

*Primary Examiner* — Eileen D Lillis
*Assistant Examiner* — Andrew Triggs
(74) *Attorney, Agent, or Firm* — Haugen Law Firm PLLP

(57) ABSTRACT

A retractable load-bearing cover apparatus is selectively deployable and retractable along a track defining a path of travel between first and second terminus points. The load-bearing cover apparatus includes a plurality of sections that are deployable along the track in a first direction, and retractable along the track in a second, opposite direction, wherein adjacent ones of the plurality of sections are releasably engagable to one another. The cover apparatus includes a drive system for deploying and retracting the sections along the track, and a storage system for disengaging the sections and arranging such disengaged sections into a vertically stacked orientation.

16 Claims, 13 Drawing Sheets

42
46B
15
W
28
14
22
L
30
31
46A
32
22
13
26
44

42
31
30
17
48
30
36
34
13
14
23
34
26
34
24
34
38
32
44

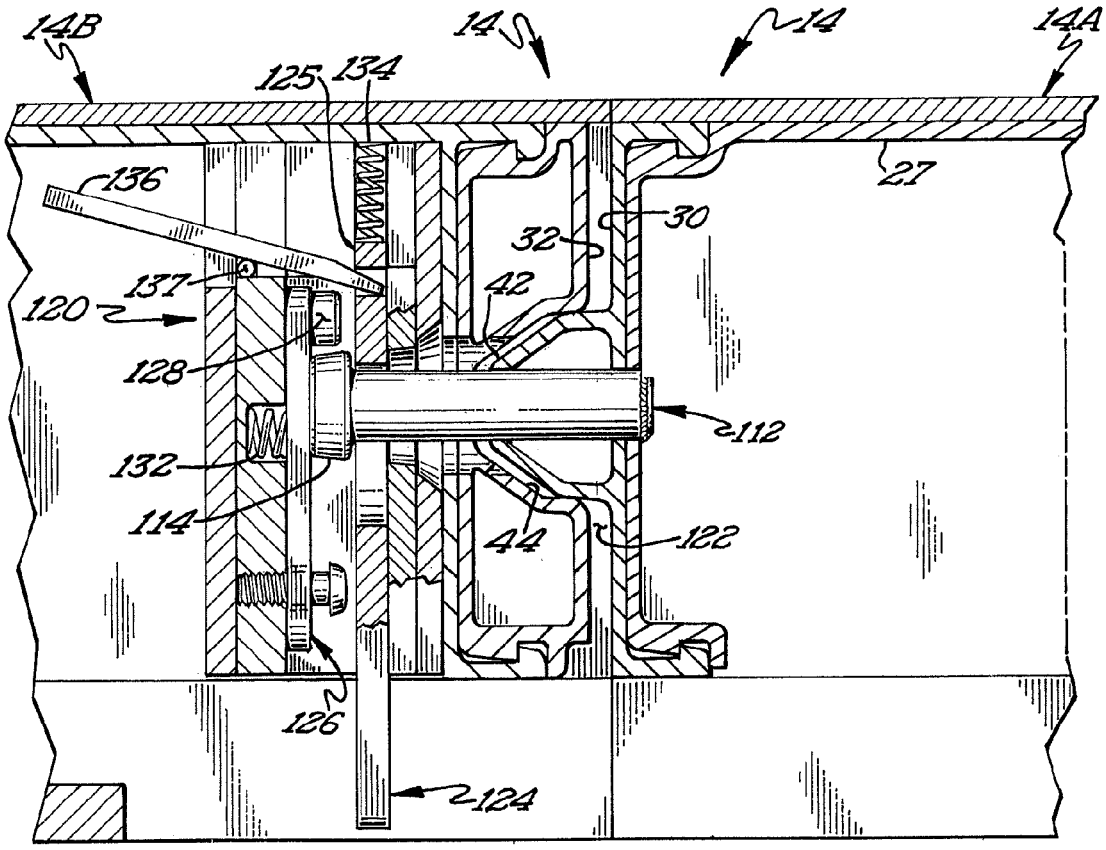
Fig 4B
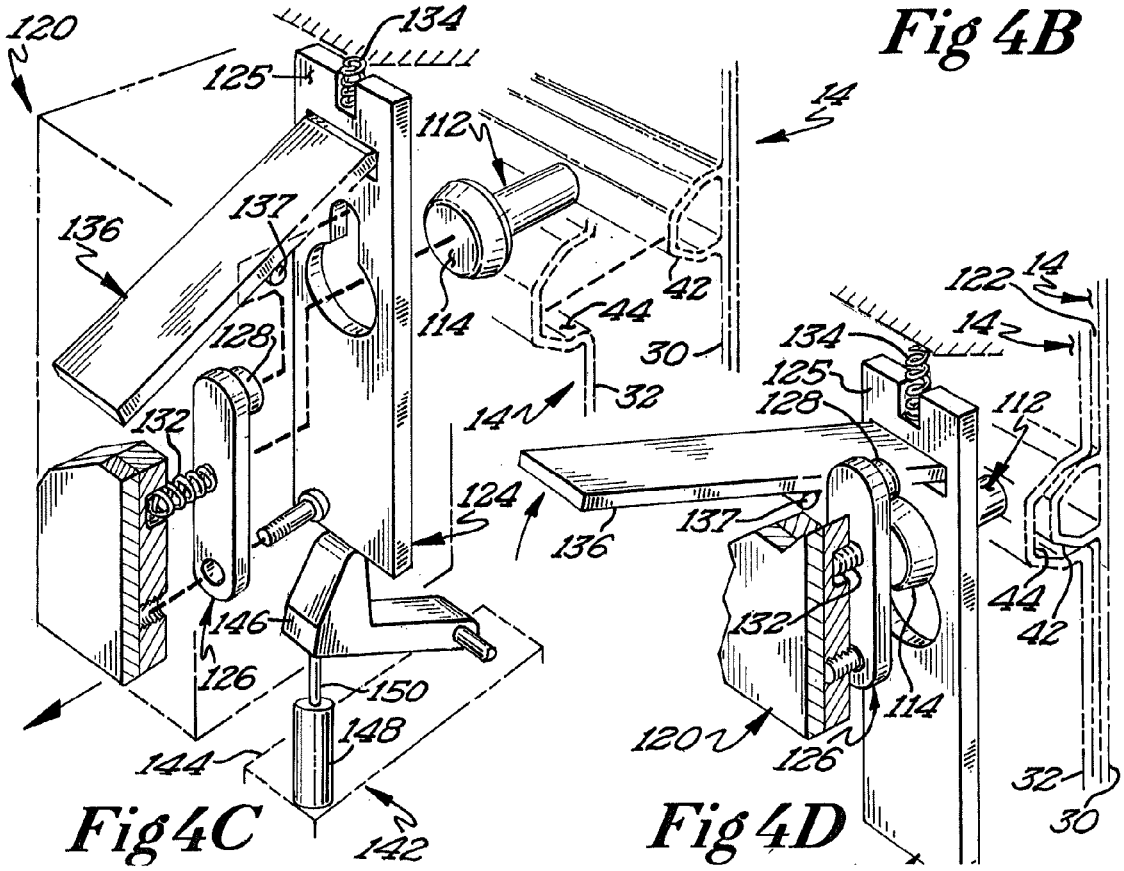
Fig 4C
Fig 4D

RETRACTABLE LOAD-BEARING COVER

FIELD OF THE INVENTION

The present invention relates to deployable and retractable covers generally, and more particularly to a deployable and retractable load-bearing cover that may be separable into individual sections for compact vertical stacking and storage thereof when the cover is in a retracted condition.

BACKGROUND OF THE INVENTION

Structures for covering surfaces or voids take on numerous forms and arrangements. Typically, covers are used to conceal and/or protect underlying surfaces. Rarely, however, are such covers capable of concealing and/or protecting as well as for bearing loads placed thereupon. An example for illustrative purposes are pool covers used to cover at or below-grade swimming pools. Most commonly, swimming pool covers are fabricated from a relatively flexible material, and may be deployed into a covering condition through, for example, unwinding the cover material from a roll. Flexible swimming pool covers are widely utilized for a variety of purposes, including retention of thermal energy in the pool water, prevention of debris collection in the pool, and aesthetics. Such pool covers, however, are not load-bearing to an extent to which the covers may be used as a floor surface to walk upon.

Other example covers include simple floor covering of various design and arrangement, such as carpeting or the like. Such floor coverings, however, also fail to provide a load-bearing surface in a self-supporting manner. In other words, such floor coverings rely upon the load-bearing support of the underlying floor, and are therefore not self-supporting of a load placed thereupon.

The term "load" as used herein is intended to mean a load representative of, for example, a weight of at least one adult human, such as a load density of 100 pounds per square foot. The term "self-supporting" as used herein is intended to mean a structure which is capable of supporting a load without substantially deviating from an unloaded configuration, without structural damage thereto, and/or without supportive aid from another structure throughout at least a substantial portion of a load support area of the load-bearing structure.

An example load-bearing cover is described in U.S. Pat. No. 6,202,355, the entire content of which being incorporated herein by reference. The cover of U.S. Pat. No. 6,202,355 incorporates a plurality of hinged panels that may be selectively deployed into a covering configuration and retracted into a compact storage configuration. One embodiment of U.S. Pat. No. 6,202,355 provides a compact storage arrangement in the form of a folded "accordion" type arrangement.

A compact panel storage arrangement contemplated by the present invention involves separating and stacking the panels in close proximity to one another. In one embodiment, the separated and stacked panels may be substantially vertically stacked with each panel remaining in a substantially horizontal orientation. Other compact storage orientations, however, are contemplated as being obtainable through the system of the present invention. It has been found that a separated and stacked panel storage arrangement may be preferable in certain applications over the "accordion" style arrangement described in U.S. Pat. No. 6,202,355. Accordingly, it is a principle object of the present invention to provide a load-bearing cover system involving a plurality of panels that may be coupled to one another and deployed as a cover, and may further be at least partially decoupled and stored in a compact stacked arrangement.

It is a further object of the present invention to provide a deployable and retractable load-bearing cover which automatically couples and decouples adjacent panels in the deployment and retraction processes.

It is another object of the present invention to provide a load-bearing cover that may be selectively retracted into a compact storage arrangement.

SUMMARY OF THE INVENTION

By means of the present invention, a load-bearing cover may be selectively deployed and retracted, and when in a retracted condition, may be stored in a convenient and compact configuration. The system of the present invention is capable of deploying and retracting such load-bearing cover automatically.

In one embodiment, the retractable cover apparatus of the present invention includes a track which defines a path of travel between first and second terminus points, and a plurality of sections deployable along the track in a first direction toward the first terminus point, and retractable along the track in a second direction opposite the first direction and toward the second terminus point. Adjacent ones of the plurality of sections are releasably engagable to one another. The cover apparatus further includes a drive system for deploying and retracting the sections along the track, and a storage system for disengaging the releasably engaged sections, and for arranging the disengaged sections into a vertically stacked orientation. When in the vertically stacked orientation, the sections define respective planes disposed substantially horizontally and in parallel with one another.

BRIEF DESCRIPTION OF THE DRAWINGS

FIG. 4B is a schematic view of the apparatus illustrated in FIG. 4A upon relative motion between adjacent cover panels in the retractable cover apparatus of the present invention;

FIG. 4C is a schematic diagram of a locking pin and latch apparatus of the present invention;

FIG. 4D is a schematic diagram of a locking pin and latch mechanism of the present invention;

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various embodiments of the invention. Other embodiments and aspects of the invention are recognized as being within the grasp of those having ordinary skill in the art.

Figure 1:
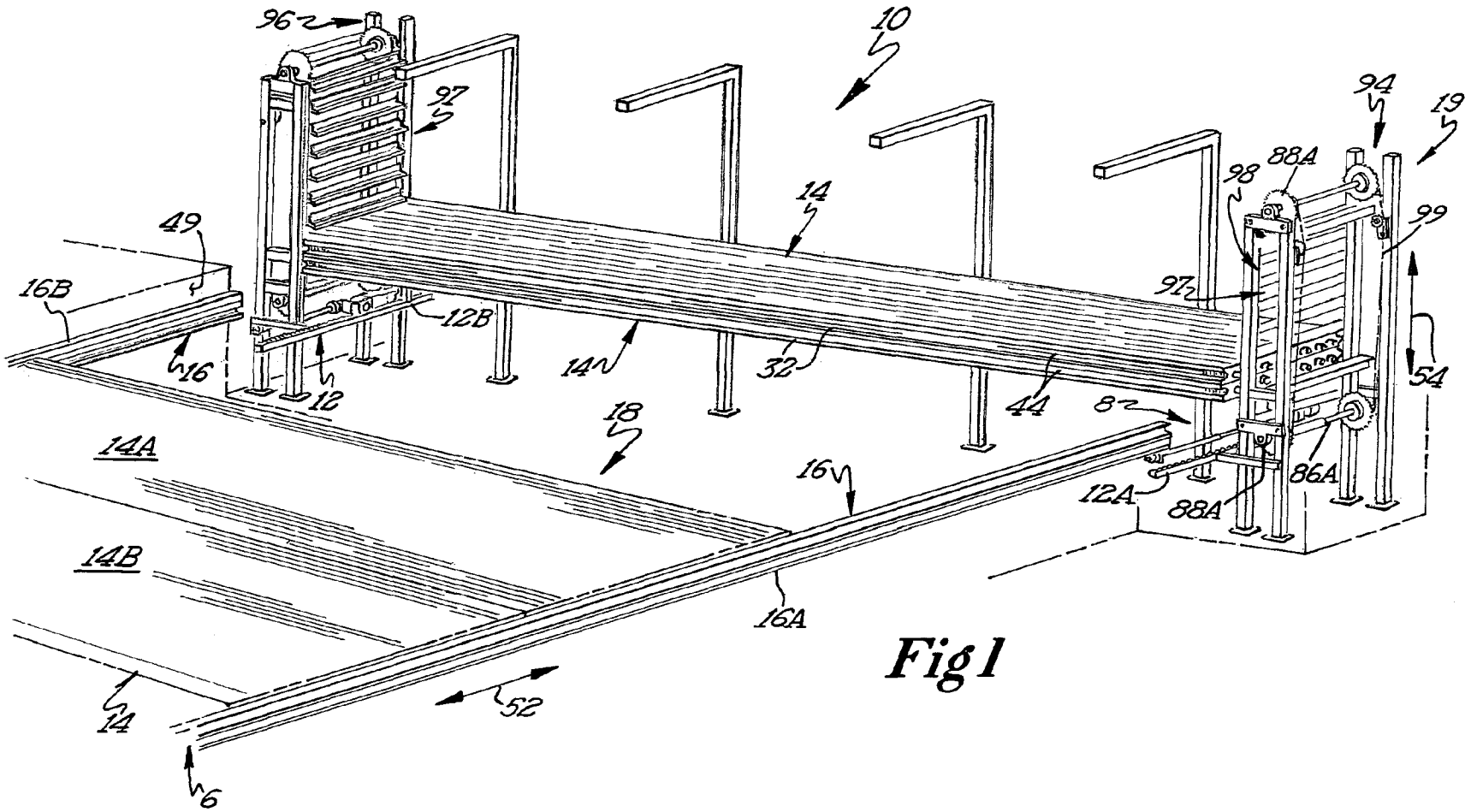
FIG. 1 is a schematic view of a retractable cover apparatus of the present invention.

With reference now to the drawing figures, and first to FIG. 1, a cover apparatus 10 includes a drive system 12 which operates to deploy, retract, and stack cover panels 14, which comprise sections of load-bearing cover 18. In some embodiments, cover panels 14 may be sequentially deployed along track 16 in order to form load-bearing cover 18. In the retraction or retrieval process, cover panels 14 are at least partially decoupled and stacked at storage system 19 for compact storage purposes. In one embodiment, stacking of cover panels 14 is accomplished in a substantially vertical arrangement with each cover panel 14 defining respective planes remaining in a substantially horizontal orientation.

One embodiment of cover panels 14 is illustrated in isolation in FIGS. 2A-2F. In one embodiment, cover panels 14 may be as described in U.S. Pat. No. 6,202,355, which was incorporated by reference hereinabove. In such embodiment, cover panels 14 may be formed by attaching a plurality of aluminum beams 22 to one another along respective longitudinal sides thereof. Such aluminum beams may each be, for example, 6 inches in width, such that a combination of eight aluminum beams secured side-to-side renders a cover panel 14 having a width dimension "W" of about 4 feet. The length dimension "l" of each cover panel 14 is dependent upon the size of the area to be covered by load-bearing cover 18. Typically, such length dimension "l" is between about 8 feet and 16 feet, though a variety of other dimensions may instead be effectively utilized.

Figures 2A, 2B:
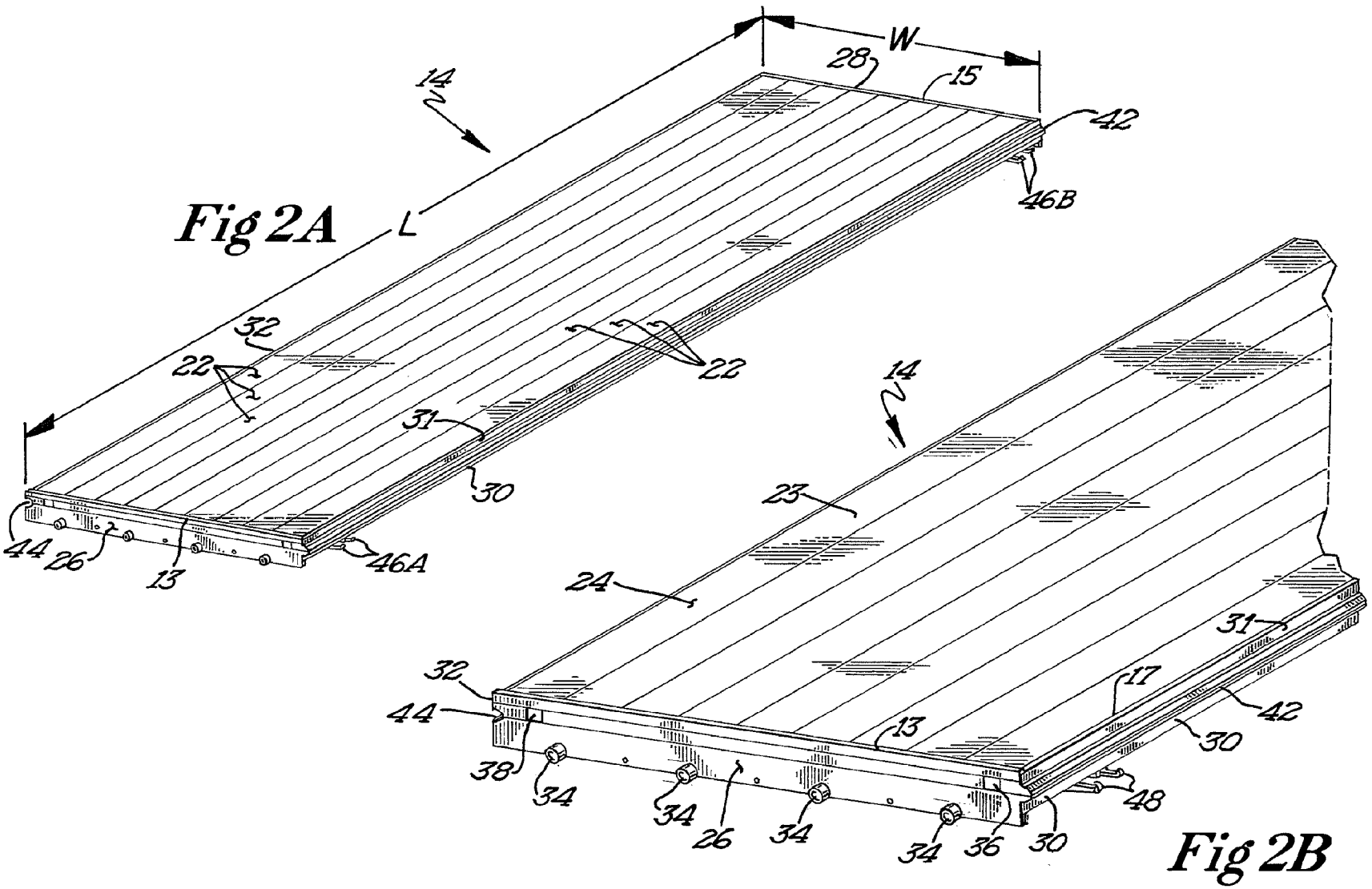
FIG. 2A is an isolation view of a portion of the retractable cover apparatus illustrated in FIG. 1.
FIG. 2B is an enlarged view of a portion of the structure illustrated in FIG. 2A.
Figure 2C:
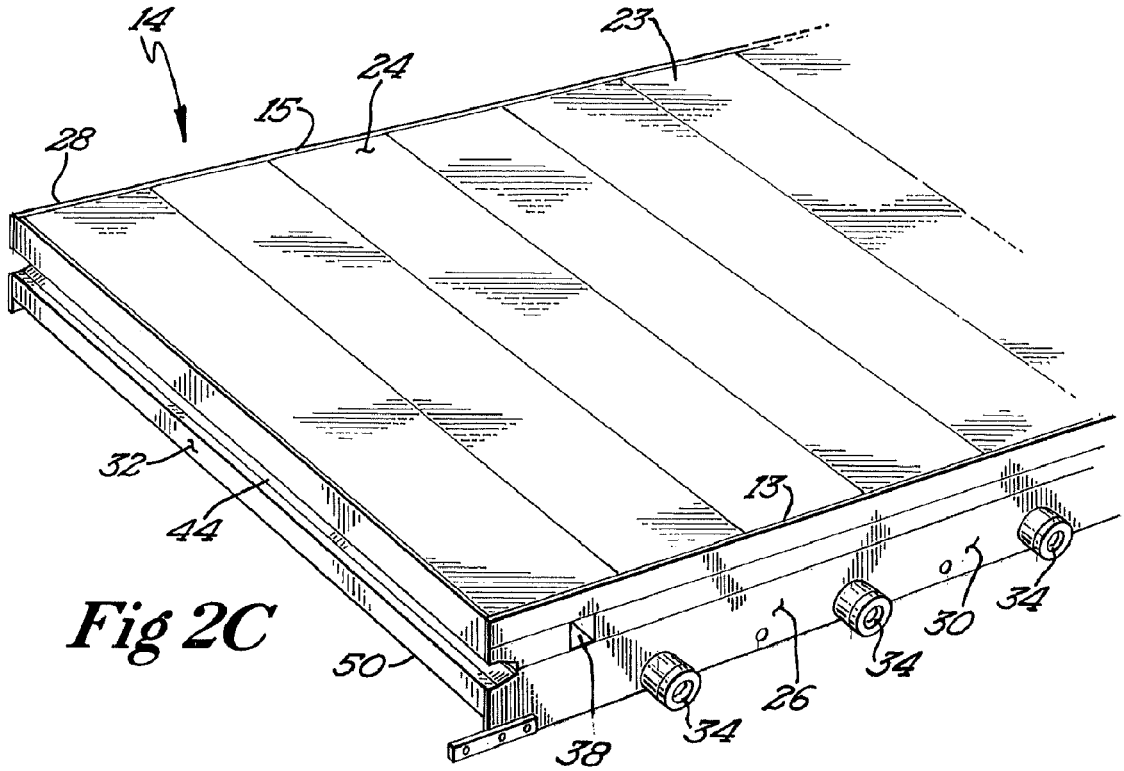
FIG. 2C is an additional perspective view of the portion of the retractable cover apparatus illustrated in FIGS. 2A and 2B.
Figure 2D:
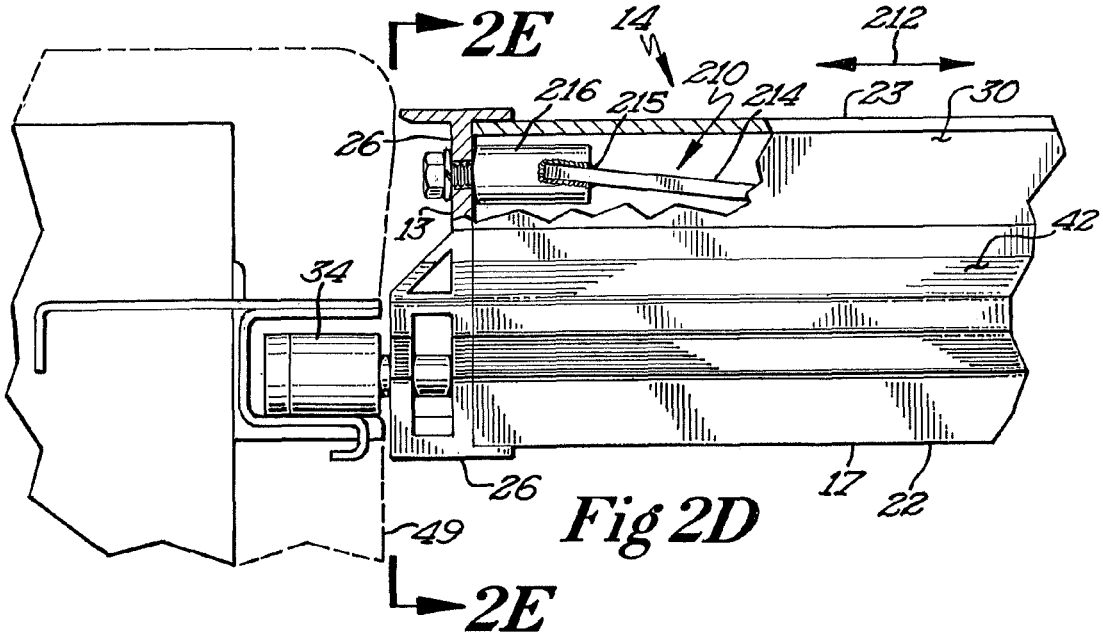
FIG. 2D is a schematic view of a portion of the retractable cover apparatus of the present invention.
Figure 2E:
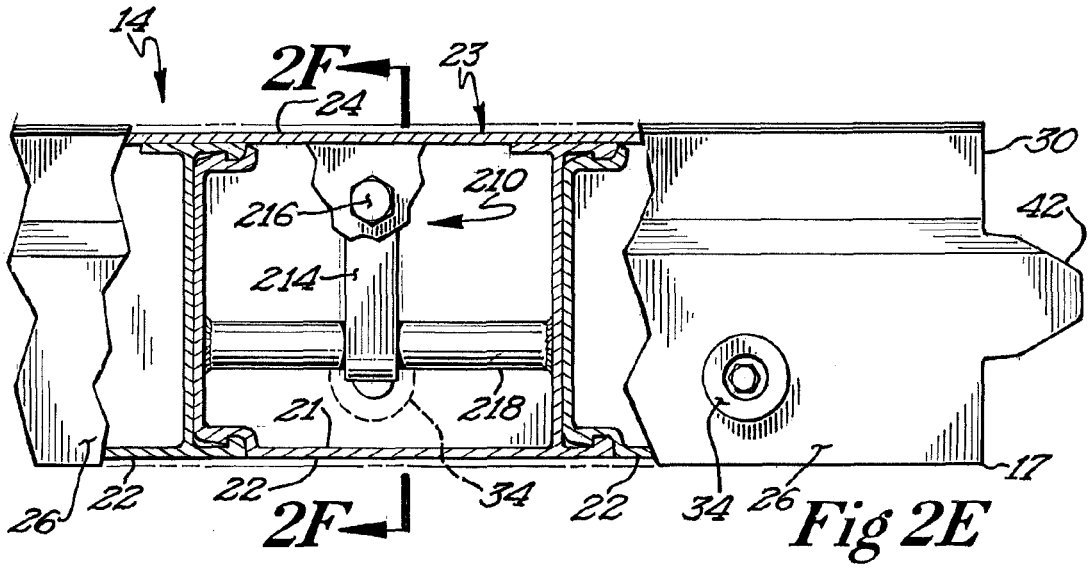
FIG. 2E is a partial cut-away view of a cover panel of a retractable cover apparatus of the present invention.

A schematic cross-sectional side view of the cover panel 14 is illustrated in FIG. 2E, wherein aluminum beams 22 are substantially C-shaped beams that may be nested in adjacent beams to form the cover panel structure. Applicants have determined that, while a variety of structural beam configurations may be employed in the construction of cover panel 14, the nested C-shaped beams provide desired strength characteristics in a relatively light weight arrangement. Cover panels 14 may further include a front end cap 30 secured at front edge 17 of cover panel 14, and includes a "tongue" protrusion 42. Moreover, cover panel 14 may further include a rear end cap 32 having a "groove" recess 44 that is configured to operably receive protrusion 42 of an adjacent cover panel 14. Beams 22 may be covered by aluminum sheets 23 to thereby enclose beams 22 within cover panel 14.

Individual beams 22 may be fabricated as indicated above from aluminum, or may instead be fabricated from one or more of a variety of structurally adequate materials. Accordingly, it is contemplated that materials such as metal alloys, polymers, and ceramics may also or instead be used in the fabrication of beams 22. Moreover, cover panels 14 may be created as monolithic structures instead of a combination of individual beams. In essence, the particular materials, formation processes, sizes, and arrangements making up cover panels 14 are not deemed critical to the present invention. Rather, it is to be understood that those of ordinary skill in the art are capable of selecting materials and components useful in the production of load-bearing cover panels 14. To that end, it is important merely that cover panels 14 be of sufficient strength to support a predetermined minimum load placed at any location of upper surface 24 of cover panels 14, and particularly when cover panels 14 are deployed as load-bearing cover 18. In some cases, such predetermined minimum load may be the weight of at least one adult human, or may be about 100 pounds per square foot.

In the illustrated embodiments, respective upper surfaces 24 of each cover panel 14 are substantially co-planar when load-bearing cover 18 is in a deployed condition. Other arrangements, such as non-co-planarity of upper surfaces 24 of cover panels 14, are also contemplated by the present invention.

Cover panels may include first and second side caps 26, 28 and front and rear end caps 30, 32. First and second side caps 26, 28 may be substantially mirror images of one another, may be configured to cover respective ends of beams 22, and may be arranged to couple cover panels 14 to track 16. In one embodiment, first and second side caps 26, 28 may be welded at respective side edges 13, 15 of cover panel 14. Other methods for securing first and second side caps 26, 28 at side edges 13, 15 of cover panels 14, however, are also contemplated by the present invention. First and second side caps 26, 28 may, in one embodiment, also be fabricated from aluminum. However, other materials, such as those described above with reference to beams 22, may be utilized in the manufacture of first and second side caps 26, 28.

One or more bushings 34, which are configured for engagement with corresponding channels of track 16, may be provided at first and second side caps 26, 28. Such bushings 34 are intended to provide both coupling of cover panels 14 to track 16, as well as facilitating of movement of cover panels 14 along track 16 substantially in the directions indicated by double arrow 52, which defines the path of travel of cover panels 14. Consequently, bushings 34 may be rotatable, and are preferably a strong and durable material for supporting the substantial weight of cover panels 14 at the respective coupling points to track 16, as well as a material that minimizes frictional resistance to motion along track 16. An example material that has been found to be useful in bushing 34 is Delrin®, which is available from E.I. du Pont de Nemours and Company, though it is contemplated that a host of other materials or material combinations may be effective in bushings 34.

In some embodiments, additional coupling and/or support members may be provided at first and/or second side caps 26, 28. For example, rotatable wheels may be mounted at locations 36, 38, with similar locations being provided but not shown at second side cap 28.

Figure 3:
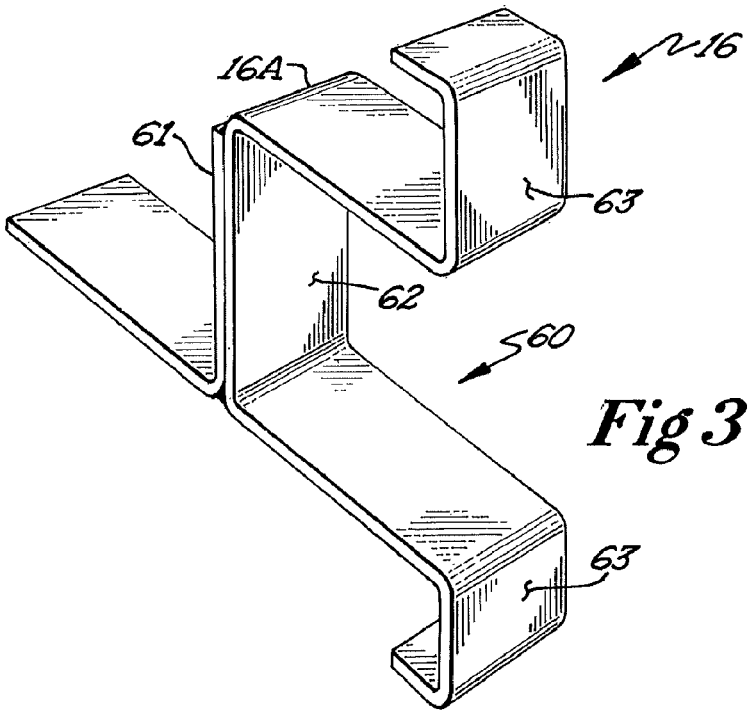
FIG. 3 is an isolation view of a track portion of a retractable cover apparatus of the present invention.

One embodiment for track 16 is illustrated in isolation in FIG. 3, wherein track section 16A may comprise an extrusion, such as an aluminum extrusion, that is formed to define a channel 60 at an inner surface 62 of track section 16A. In one embodiment, track section 16A may constitute one of a pair of track sections making up track 16, wherein the pair of track sections are disposed at opposed sides of an area desired to be covered by retractable cover apparatus 10 of the present invention. In one example, the area covered by cover apparatus 10 may be a pool, wherein track 16 is embedded in the upstanding sidewalls 49 of the pool. In such an embodiment, outer surfaces 63 of track 16 may be substantially coextensive with the wall surface of the pool. Bearing portion 61 of track section 16A may accordingly be embedded in the upstanding wall of the pool, leaving channel 60 open for operably receiving, for example, bushings 34 of cover panels 14.

Front end cap 30 may be secured at a first end edge 17 of cover panel 14 through a variety of mechanisms, including welding and the like. In one embodiment, front end cap 30 includes a protrusion 42 extending along length dimension "l" thereof. In other embodiments, however, protrusion 42 may extend only partially along length dimension "l" of front end cap 30 and/or may be provided intermittently along length dimension "l" of front end cap 30. In still further embodiments, front end cap 30 may be substantially planar without a protrusion 42 disposed thereat. Protrusion 42 may take on a variety of configurations, and may include a plurality of apices. Typically, protrusion 42 is configured to engage with recess 44 at rear end cap 32. Such engagement can assist in retaining adjacent cover panels 14 in intimate contact with one another while in a deployed condition. It is to be understood, however, that the arrangement of protrusion 42 with a recess 44 is optional, and that no such features are required in order to carry out the objects of the present invention.

Typically, engagement between protrusion 42 and recess 44 further assists in providing load support at junctions of adjacent cover panels 14. Specifically, protrusion 42 of first panel 14A is in operable engagement with recess 44 of second cover panel 14B. Respective upper surfaces 24 of first and second cover panels 14A, 14B may be operably arranged in substantially co-planar orientation.

Figure 2F:
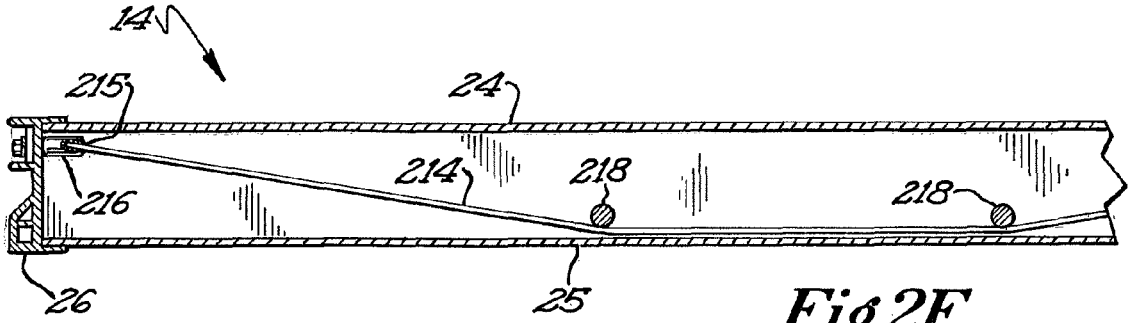
FIG. 2F is a further cut-away view of a portion of the retractable cover apparatus of the present invention.

In the partial cutaway view of FIGS. 2D-2F, a tensioning mechanism for cover panels 14 is illustrated. In some embodiments, cover panels 14 may include tensioning mechanisms 210 for selectively tensioning cover panel 14 along at least a length axis 212 thereof. In the illustrated embodiment, tensioning mechanisms 210 include tensioning straps 214 secured to first and second side caps 26, 28 by through-bolts 216, which extend through respective first and second side caps 26, 28. Tensioning straps 214 are secured to through-bolts 216 through one of a variety of securement techniques, such as welding, or the like. Tensioning straps 214 may be formed of various materials which exhibit adequate strength for the tensioning process. For example, tensioning straps 214 may be fabricated from steel.

Tensioning mechanisms may further include tensioning struts 218 under which tensioning straps 214 operably bear. Tensioning straps 218 may be secured between respective side walls of C-beams 22, and may be positioned near respective bases 21 of beams 22 to maximize leverage attainable by tensioning mechanisms 210. Such leverage is further maximized by positioning through-bolts 216 at upper portions of first and second side caps 26, 28, wherein maximizing relative height differential between through bolts 216 and tensioning struts 218 facilitates tensioning of cover panel 14. Tensioning struts 218 may be secured in place by welding or the like, and in one embodiment may be welded along at least an upper portion of the junction between tensioning struts 218 and sidewalls of beams 22, wherein the "upper portion" is defined relative to upper and lower surfaces 24, 25 of cover panel 14.

To selectively tension cover panel 14, at least along length axis 212, one or both of the through-bolts 216 secured to each tensioning strap 214 may be actuated against, for example, a nut, thereby drawing coupled ends 215 of tensioning strap 214 toward first and second side caps 26, 28. To decrease tension along at least axis 212, through-bolts 216 are actuated to loosen tensioning strap 214 between first and second side caps 26, 28 of cover panel 14.

A further aspect of cover panel 14 is best illustrated in FIGS. 2A and 2B, wherein one or more deflectable retainer hooks 46 may extend outwardly from front end edge 17 of cover panel 14. In operation, deflectable hooks 46A, 46B may retain adjacent cover panels, such as cover panels 14A, 14B, in coupled relationship with one another. In particular, deflectable hooks 46 may be mounted at, for example, a lower surface 25 of cover panel 14 in a manner so as to be pivotable about respective axes that are substantially parallel to a longitudinal face 31 of front end cap 30. In one embodiment, such deflectable hooks 46 may be biased with biasing elements (not shown) about their respective pivot axes in an angular direction driving hook ends 48 upwardly toward upper surface 24 of cover panel 14. In this manner, hook ends 48 of deflectable hooks 46 may operably engage behind coupling edge 50 of rear end cap 32 to thereby retain adjacent cover panels 14 in coupled relationship. The biasing mechanisms described above act to drive hook ends 48 up behind coupling edge 50 of rear end cap 32. In order to decouple adjacent cover panels 14, deflectable hooks 46 are articulated against their respective biasing force through an external applied force described in greater detail herein below. Such articulation moves hook ends 48 downwardly and out of engagement behind coupling edge 50 of rear end cap 32. Through the example arrangements described above, a plurality of cover panels 14 may be selectively coupled and decoupled at respective front and rear end caps 30, 32.

Figure 4A:
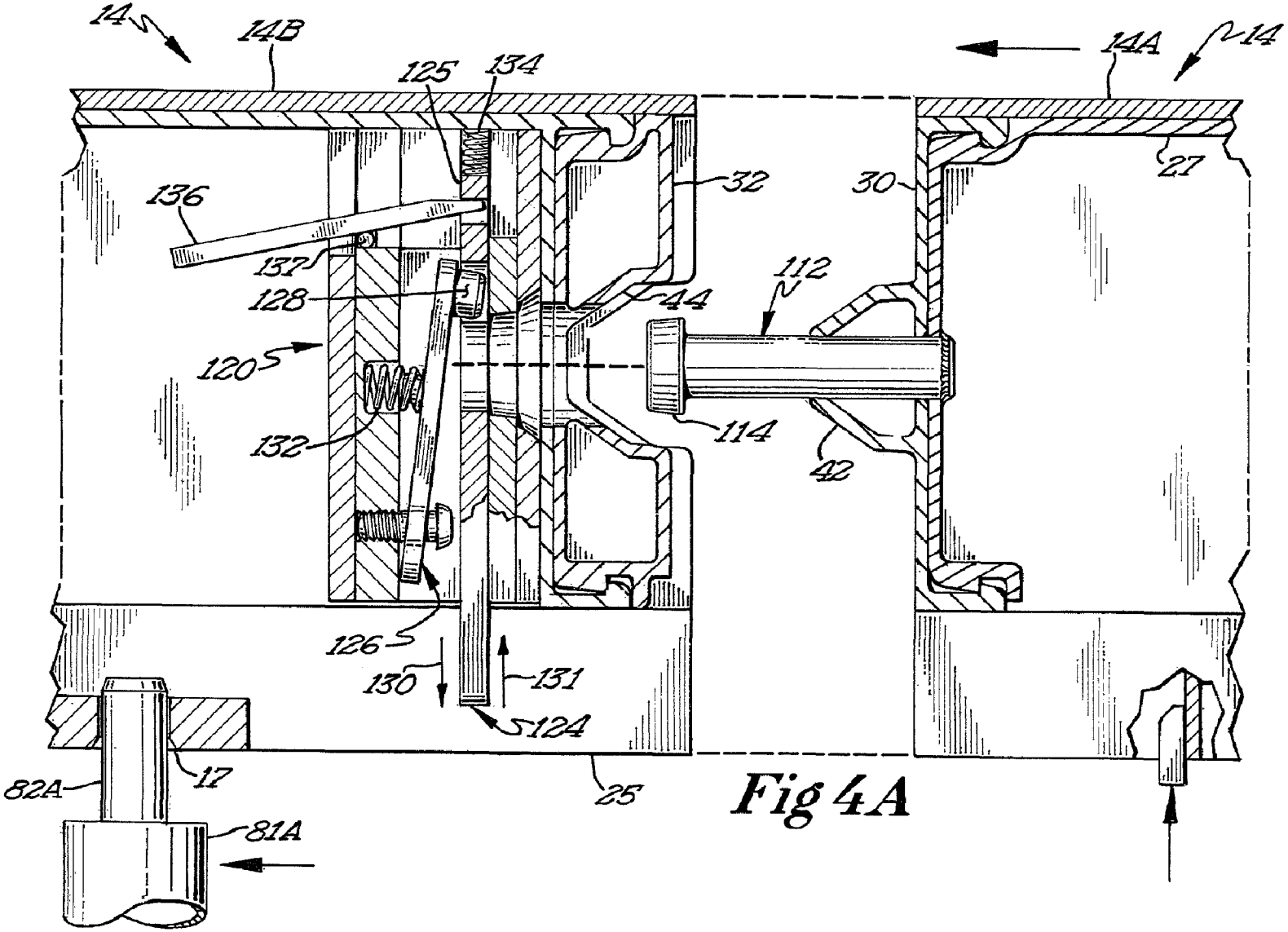
FIG. 4A is a schematic diagram of a locking pin and latch arrangement of the retractable cover apparatus of the present invention.

In another embodiment, adjacent cover panels, such as panels 14A and 14B of cover 18 may be releasably engagable to one another through the locking pin and latch arrangement illustrated in FIGS. 4A-4D. With reference first to FIG. 4A, cover panels 14 may include locking pins 112 extending outwardly from front end cap 30, and in some embodiments, through protrusion 42. Locking pins 112 may be in the form of, for example, bolts having a bolt head 114, and being secured to cover panel 14, such as at a front beam 27 of cover panel 14. In some embodiments, locking pins 112 may be secured to front beam 23 of cover panel 14 through welding, or the like. Each cover panel 14 may include a plurality of locking pins 112 disposed along front end cap 30 in order to securely releasably engage respective cover panels 14 to one another. In a particular embodiment, each cover panel 14 includes two locking pins 112 disposed near respective first and second side caps 26, 28 along front end cap 30. Applicants have determined that such an arrangement provides adequate releasable engagement between respective adjacent cover panels 14.

As shown in FIG. 4A, cover panels 14 may further include latches 120 disposed at rear sides of cover panels 14, such as adjacent to rear end caps 32 thereof. Latches 120 may be positioned at cover panels 14 in operable proximity to locking pins 112, so as to form a plurality of locking sets 122 comprising the combination of a locking pin 112 and a latch 120. Latch 120 may include a latch key hole plate 124 that is maintained in a first "open" position illustrated in FIG. 4A by spring loaded bar 126, and particularly by pin 128 of spring-loaded bar 126, which pin 128 prevents biased displacement of latch keyhole plate 124 along direction 130 when pin 128 is in the position illustrated in FIG. 4A. Spring-loaded bar 126 is biasably urged into the position illustrated in FIG. 4A by a first urging spring 132. Moreover, second urging spring 134 urges latch keyhole plate 124 along direction 130.

In some embodiments, latch 120 includes a top release lever 134 which may be actuated about top release lever pivot axis 136 to lift latch keyhole plate 124 against urging spring 134 to adjust the position of latch keyhole plate 124 from a "closed" position to the "open" position illustrated in FIG. 4A.

To releasably engage locking pin 112 with latch 120, cover panel 14A is moved along direction 140, as illustrated in FIG. 4A, so as to establish contact between locking pin 112, and particularly bolt head 114, with spring-loaded bar 126. Full engagement between cover panel 14A and 14B results in locking pin 112 acting upon spring-loaded bar 126 against first urging spring 132 to disengage pin 128 of spring-loaded bar 126 from latch keyhole plate 124. Once pin 128 is out of engagement with latch keyhole plat 124, second urging spring 134 urges latch keyhole plate 124 along direction 130 to a "closed" position, as illustrated in FIG. 4B. In such "closed" position, upper portion 125 of latch keyhole plate 124 urgedly engages locking pin 112 proximally to bolt head 114. Consequently, separation of cover panel 14A from cover panel 14B is prevented by the interaction between upper portion 125 of latch key hole plate 124 and bolt head 114 of locking pin 112. The cut-away views of 4A and 4B illustrate the releasable engagement process described above.

In the event that disengagement of cover panel 14A from cover panel 14B is desired, latch keyhole plate 124 is actuated against second urging spring 134 along direction 131, such that upper portion 125 of latch keyhole plate 124 disengages from locking pin 112. Once such disengagement takes place, cover panels 14A, 14B may be mutually separated. Urging of latch keyhole plate 124 along direction 131 may be accomplished, for example, in two ways. First, top release lever 136 may be actuated about axis 137 so as to "lift" latch keyhole plate 124 against second urging spring 134. A second method is to apply direct upward pressure to bottom edge 123 of latch keyhole plate 124 along direction 131, with such force being sufficient to overcome the urging force of second urging spring 134.

With reference back to FIG. 1, track 16 is illustrated as extending substantially along direction 52. Track 16 may comprise one or more track sections, and may be disposed at one or both sides of cover panels 14. Typically, track 16 is arranged and oriented to operably engage with first and second side caps 26, 28 of cover panels 14. In the embodiment illustrated in FIG. 2D, track 16 is configured to operably engage with at least bushings 34 disposed at first and second side caps 26, 28. Such engagement may be accomplished through the provision of one or more channels 60 at inner surface 62 of track 16, wherein channel 60 is configured to at least partially receive bushing 34 therein. As described above, bushings 34 may slidably and/or rotatably engage within channel 60 along directions 52.

In some embodiments, track 16 may be partially embedded at second surface 64 in a supporting material, such as concrete, aluminum, steel, wood, and the like. In other embodiments, however, track 16 may be secured in place through fasteners, bracketing, weldments, and the like. It is to be understood that a variety of anchoring techniques for track 16 may be employed, so long as track 16 is adequately secured to operably support cover panels 14, including, in some embodiments, all of load-bearing cover 18 in its deployed condition.

Figure 5:
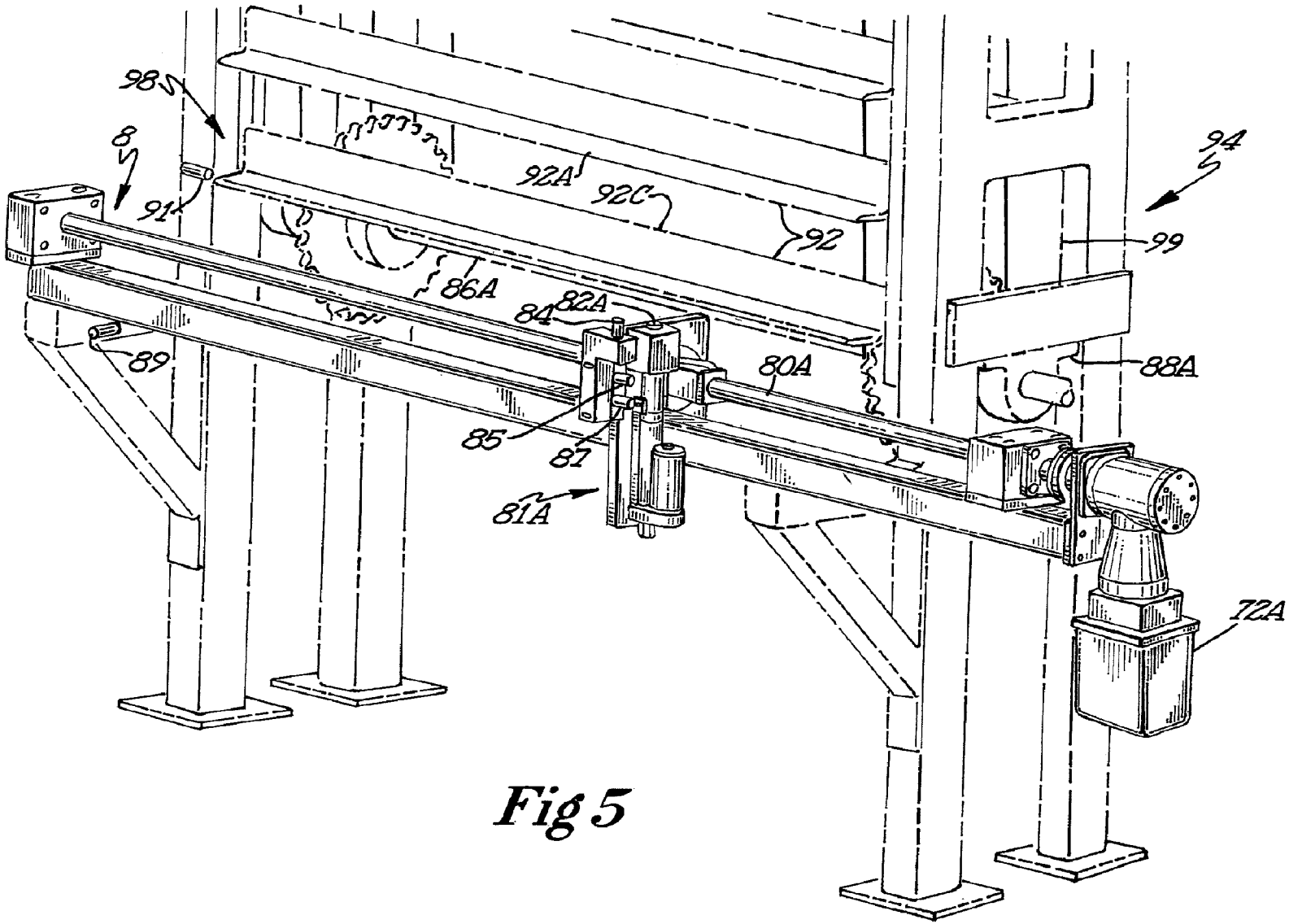
FIG. 5 is an enlarged view of a portion of a storage system of the retractable cover apparatus of the present invention.
Figure 6:
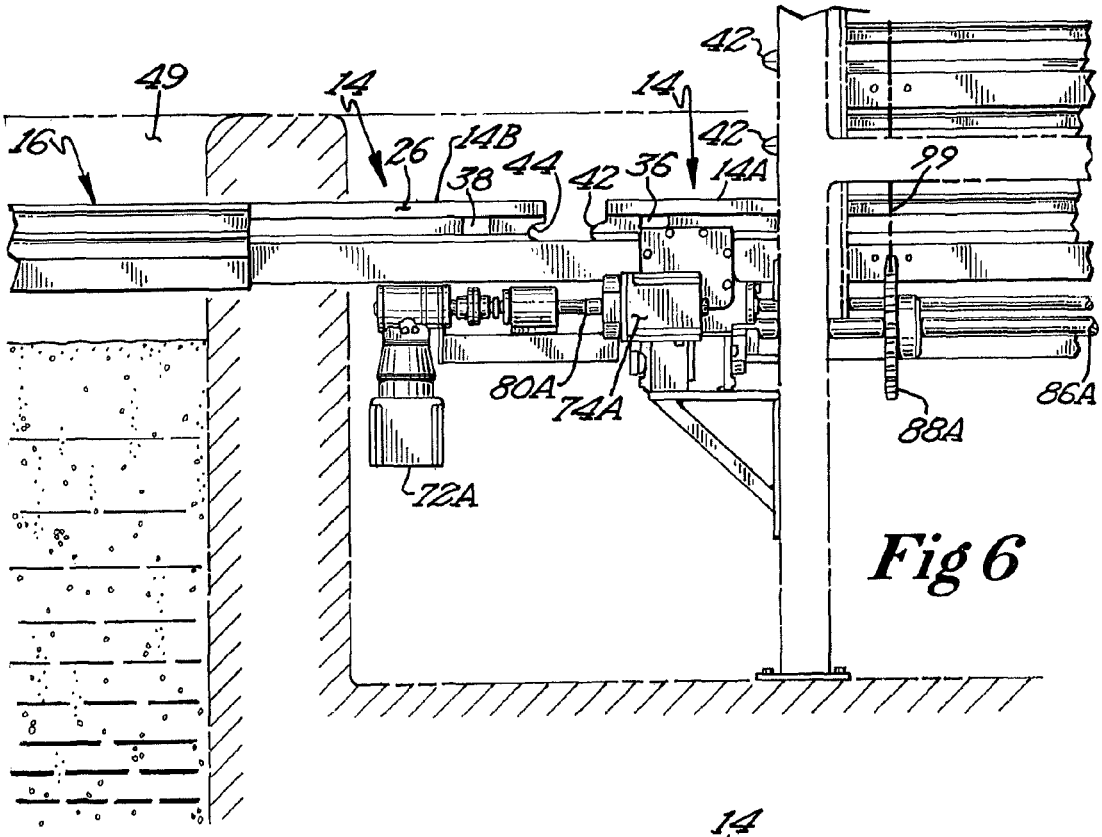
FIG. 6 is an elevation view of a portion of the retractable cover apparatus illustrated in FIG. 1.

Cover panels 14 may be deployed and retracted along a path of travel defined by track 16, and between first and second terminus points 6, 8 by drive system 12, which is best illustrated in FIGS. 1, 5, and 6. Drive system 12 may be operational with a single drive unit 12A, but is more commonly employed with first and second drive units 12A, 12B, with such first and second drive units 12A, 12B being positioned so as to each operably couple to respective cover panels 14, such as at receptacles 17 in lower surface 25 of cover panels 14. First and second drive units 12A, 12B may be controlled in their operation by control software (not shown) that is communicatively coupled to respective drive motors 72A, 74A and 72B, 74B. The two sets of drive motors 72A, 72B and 74A, 74B together operate to move cover panels 14 either along track 16 in substantially horizontal directions 52, or along storage carousels 94, 96 in substantially vertical directions 54.

First drive motors 72A, 72B are configured for rotational output to first and second screw drives 80A, 80B. First drive motors 72A, 72B are controllably operated by control software, such as Motion Works™ to rotate respective screw drives 80A, 80B at desired rotational speeds and directions, as well as rotational quantities in the form of measured moves. First drive motors 72A, 72B may be electrical stepper motors such as Yaskowa MPH Motors.

First and second screw drives 80A, 80B may include respective coupling units 81A, and 81B which may be coupled to respective first and second screw drives 80A, 80B for axial movement there along. For example, rotational movement of screw drive 80A in a first rotational direction may cause coupling unit 81A to move axially in a first direction along screw drive 80A. Rotational movement of screw drive 80A in a second rotational direction correspondingly causes coupling unit 81A to move axially along screw drive 80A in a second direction that is opposite of the first axial direction. In this manner, coupling units 81A, 81B, when in coupled relationship with a cover panel 14, move such cover panel 14 along directions 52 for deployment and retraction procedures.

Coupling units 81A, 81B may be removably coupled to cover panels 14 through a retractable pin mechanism, wherein respective retractable pins 82A, 82B may be driven upwardly from, for example, coupling units 81A, 81B into a grasping orientation behind coupling edge 50 of respective cover panels 14. In order to retrieve deployed cover panels 14, therefore, screw drives 80A, 80B are rotated by first drive motors 72A, 72B in a second rotational direction to thereby cause axial movement of coupling units 81A, 81B in a second axial direction. Such movement of coupling units 81A, 81B acts to contact retractable pins 82A, 82B with a surface of rear end cap 32 of a respective cover panel, so as to "pull" the cover panel 14 toward storage carousels 94, 96 and second terminus point 8.

In order to deploy cover panels 14 out onto track 16 toward first terminus point 6, the retractable pins 82A, 82B described above are placed into contact with a rear surface of rear end cap 32, and screw drives 80A, 80B are actuated to provide the axial motion of coupling units 81A, 81B in a pushing direction. The retractable pins 82A, 82B may be operated through mechanical, electrical, magnetic, pneumatic, or hydraulic means, and may be electrically or mechanically controlled. In one embodiment, the control software controls the deployment and retraction of the retractable pins at desired intervals.

In one embodiment, coupling units 81A, 81B include solenoids for electromagnetically driving retractable pins 82A, 82B between retracted and extended positions, wherein the extended positions of retractable pins 82A, 82B are effective in operably connecting coupling units 81A, 81B to cover panels 14. In one embodiment, retractable pins 82A, 82B are engagable with receptacles 17 in lower surface 25 of respective cover panels 14. The operation of retracting cover apparatus 10 toward second terminus point 8 may, in one embodiment, be effectuated through the following process. First, coupling units 81A, 81B are driving along respective screw drives 80A, 80B toward first terminus point 6 and underneath the cover panel 14 along track 16. When coupling units 81A, 81B arrive in proximity to receptacles 17 in such cover panel 14, a proximity sensor 84 indicates the proximity to receptacle 17 by sensing the presence of a for example, steel housing defining receptacle 17. The proximity sensors of coupling units 81A, 81B communicate with a control system (not shown) to instruct the solenoids within coupling units 81A, 81B to energize or de-energize to cause retractable pins 82A, 82B to move from a retracted position to an extended position in engagement with receptacles 17. Such movement by retractable pins 82A, 82B may be verified by retractable pin proximity sensors 85, 87 in coupling units 81A, 81B.

Once engagement between retractable pins 82A, 82B and a respective cover panel 14 is made, first drive motors 72A, 72B actuate first and second screw drives 80A, 80B to cause coupling units 81A, 81B to move axially toward second terminus point 8, thereby pulling cover panel 14, as well as all other cover panels on track 16, toward second terminus point 8. Coupling units 81A, 81B continue to move cover 18 toward second terminus point 8 by a measured move along screw drives 80A, 80B to a latch release position at which latches 120 of cover panel 14B are aligned with latch release mechanisms 142. In some embodiments, both receptacles 17 and latches 120 may be positioned near rear end cap 32 of respective cover panels 14. Cover apparatus 10 may include latch release proximity sensors for indicating the position of a cover panel 14 at the latch release position.

Once proximate panel 14A is in the latch release position, the control system instructs latch release mechanism 142 to engage latch keyhole plate 124 to drive it upwardly against second urging spring 134 to thereby enable disengagement of first cover panel 14A from second cover panel 14B. In one embodiment, latch release mechanism 142 includes a brace portion 144 which anchors latch release mechanism 142 to a solid fixed structure. Latch release mechanism 142 further includes a latch engagement arm 146 that is selectively brought into engagement with latch keyhole plate 124 by the action of urging mechanism 148. In some embodiments, urging mechanism 148 includes a pneumatically or hydraulically-driven pin 150 that selectively upwardly displaces engagement arm 146 into operating engagement with latch keyhole plate 124. In this manner, urging pin 150 may be selectively extended to effectuate the releasing mechanism of latch 120. In some embodiments, latch release mechanism 142 further includes an urging pin proximity sensor which detects and indicates the position of pin 150. When latch release mechanism 142 is instructed to engage latch 120, urging pin proximity sensor confirms that urging pin 150 has extended and urged engagement arm 146 into releasing engagement with latch keyhole plate 124. Such confirmation enables the control system to instruct first drive motor 72A, 72B to re-start and to drive coupling units 81A, 81B further toward second terminus point 8. With engagement arm 146 lifting latch key hole plate 124 against second urging spring 134 to an extent sufficient to disengage latch keyhole plate 124 from locking pin 112, movement of coupling units 81A, 81B toward second terminus point 8 with retractable pins 82A, 82B engaged with receptacles 17 in first cover panel 14A operably disengages first cover panel 14A from second cover panel 14B.

First drive motors 72A, 72B continue to actuate first and second screw drives 80A, 80B to axially move coupling units 81A, 81B further toward second terminus point 8. First drive motors 72A, 72B may be instructed to make a measured move of first and second screw drives 80A, 80B between the latch release position and a home position, where home proximity sensors may be provided to detect and indicate the presence of first cover panel 14A. In some embodiments, end of travel proximity sensors 87 may also be provided to detect the presence of coupling units 81A, 81B at the end of travel along first and second screw drives 80A, 80B at second terminus point 8. First drive motors 72A, 72B are stopped at the end of the measured move and/or indication by the home and/or end of travel proximity sensors by the presence of the cover panel, such as first cover panel 14A. At this juncture, retractable pins 82A, 82B are retracted out from engagement with receptacles 17 of cover panel 14A.

In another embodiment of the cover panel retrieval process, proximal ends (not shown) of the deflectable hooks 46 come into contact with a ramp or other deflection structure at to cause such deflection hooks to deflect and rotate about their respective pivot axes against their respective biasing force, and to accordingly disengage hook ends 48 from a respective coupling edge 50. In other embodiments, however, a first set of deflection surfaces are provided to first disengage deflectable hooks 46 between adjoining cover panels 14 prior to the retractable pins 82A, 82B being retracted during the cover panel retrieval process. In this arrangement, drive system 12 continues to pull upon a cover panel 14 even after such cover panel 14 has been disengaged from an adjoining cover panel 14. Ultimately, each successive cover panel 14 may become completely disengaged from both adjoining cover panels 14 as well as coupling units 81A, 81B in the cover panel retrieval process.

Second drive motors 74A, 74B are also controlled by the control system, and are configured to provide rotatable output to drive shafts 86A, 86B of carousels 94, 96. Second drive motors 74A, 74B may be electrical stepper motors such as Yaskowa MPH Motors. The rotational output of such second drive motors 74A, 74B turns respective drive shafts 86A, 86B in desired rotational directions. Drive shafts 86A, 86B may be coupled to a respective chain drive systems 88A, 88B to drive panel stanchions 92 about a continuous track extending along carousels 94, 96 of storage system 19. In doing so, panel stanchions 92 positioned at lower surface 25 at first and second sides 26, 28 of cover panels 14 act to operably vertically lift respective cover panels 14 from a docking location 98. When drive shafts 86A, 86B are rotated in a second rotational direction, panel stanchions 92 are lowered to subsequentially place cover panels 14 at docking station 98 for sequential deployment along track 16.

The control software operates first and second drive motors 72A, 72B, 74A, 74B in connection with a plurality of sensors (not shown), which detect the presence or absence of a cover panel at specific locations of storage system 19. For example, when the sensor 91 detects the presence of a cover panel 14 at docking station 98 during the retrieval and storage process, the control software actuates second drive motors 74A, 74B to rotate drive shafts 86A, 86B in a first rotational direction to lift the cover panel from the docking station 98 at a set of cover stanchions 92. Moreover, such sensors provide the control software with information for operating first drive motors 72A, 72B in rotating respective screw drives 80A, 80B. In the retrieval and storage process, for example, first drive motors 72A, 72B are actuated to rotate respective screw drives 80A, 80B in a first rotational direction to thereby cause coupling units 81A, 81B to move axially outwardly and to cause the retractable pins to come into contact and engagement with a cover panel 14 disposed at track 16. When coupling units 81A, 81B have reached an engagement position, first drive motors 72A, 72B are instructed by the control software to operate screw drives 80A, 80B in a second opposite rotational direction to thereby move coupling units 81A, 81B in a second axial direction so as to pull back on the coupled cover panel 14.

In one embodiment, retractable cover apparatus 10 includes a storage system 19 having first and second storage carousels 94, 96 adapted to arrange disengaged cover panels 14 into a vertically stacked orientation, wherein such disengaged cover panels 14 define respective planes disposed substantially horizontally and in parallel with one another. First and second storage carousels 94, 96 may each include a rack 97 having a plurality of cover stanchions 92 for supporting opposed ends of each disengaged panel cover 14. For example, a cover panel 14 may be supported at one end by stanchion 92A at storage carousel 94, and at the other end by stanchion 92B at storage carousel 96. In a preferred embodiment, such stanchions 92A, 92B are substantially aligned with one another, such that a cover panel 14 supported thereby defines a substantially horizontal plane.

As described above, second drive motors 74A, 74B are operably coupled to respective first and second storage carousels 94, 96 so as to selectively drive rack 97 along a storage path 99, which may be a continuous path defined by chain drive systems 88A, 88B. In such a manner, rack 97 is movable throughout storage path 99 through the actuation of drive shafts 86A, 86B by second drive motors 74A, 74B. As illustrated in FIG. 5, storage path 99 is at least partially vertically aligned, and may be arranged to facilitate a first storage position 101 in which stanchions 92 of rack 97 are vertically stacked above docking station 98. In this manner, at least a portion of storage path 99 is substantially perpendicular to the path of track 16 defined by directions 52.

In one embodiment, storage system 19 operates to vertically stack cover panels 14 as follows. With a cover panel, such as cover panel 14A, positioned at docking station 98, defined as the home position at second terminus point 8 in horizontal alignment with track 16, a "clearance" signal may be obtained by the control system indicating that cover panel 14A is successfully disengaged from adjacent cover panel 14B. In some embodiments, such a clearance signal may be obtained by confirming the presence of an electromagnetic signal passing between first and second track sections 16A, 16B at a position between first and second cover panels 14A, 14B. The electromagnetic signal may be accomplished at a variety of electromagnetic wavelengths, including within the visual and infrared wave length ranges. Electromagnetic signal detection systems are well known in the art, and are readily available for indicating a signal across a span, thereby instructing the control system that no object is in the detection path. If the clearance signal is achieved, the control system is cleared to proceed with actuating second drive motors 74A, 74B of storage system 19, in that disengagement of first cover panel 14A from second cover panel 14B has been affected.

Prior to positioning first cover panel 14A at docking station 98, rack 97 is positioned at both first and second storage carousels 94, 96 such that a first set of stanchions 92A, 92B are positioned at docking station 98. Confirmation of such positioning of first stanchion set 92A, 92B may be accomplished with stanchion locator proximity sensors configured to detect the presence of stanchions 92A, 92B at docking station 98.

Second drive motors 74A, 74B are then energized to rotate respective drive shafts 86A, 86B to move rack 97 along storage path 99 until a second set of stanchions 92C, 92D arrive at docking station 98. In some embodiments, second drive motors 74A, 74B are stepper motors, so as to produce measured moves controlled by the control system. The accurate completion of the measured moves of second drive motors 74A, 74B may be confirmed by indication from slat locator proximity sensors detecting the presence of a set of stanchions 92 at, for example, docking station 98. Moreover, second drive motors 74A, 74B are preferably controllable to simultaneously move respective racks 97 of first and second storage carousels 94, 96 at an equal rate, so that respective stanchion sets between first and second storage carousels 94, 96 remain substantially aligned along a horizontal plane, thereby maintaining cover panels 14 substantially level during and after the storage procedure. Upon completion of the measured move, second drive motors 74A, 74B are deactivated to halt respective racks 97 in a position so that second cover panel 14B may be moved by first drive motors 72A, 72B into docking station 98 for loading at second stanchion set 92C, 92D. This process repeats until the desired number of cover panels are loaded in a vertically stacked orientation at storage system 19. In one embodiment, a fully stored condition of cover apparatus 10 includes all cover panels 14 at storage system 19, with the last cover panel 14 remaining at docking station 98.

To deploy cover panels 14 from storage system 19 out along track 16, the above-described process is reversed. In that case, the particular cover panel 14 which is operably extended to first terminus point 6 upon full deployment of cover 18 is operably moved by first drive motors 72A, 72B from, for example, docking station 98 to a measure point along track 16, with such movement being controlled as a measured move of first drive motors 72A, 72B, and confirmed by appropriate proximity sensors. Rotation of drive shafts 86A, 86B of storage system 19 is reversed by second drive motors 74A, 74B to position a subsequent cover panel 14 at docking station 98. Such subsequent cover panel is then moved into engagement with the previously described cover panel 14 through the action of first drive motors 72A, 72B. Such cover panels are releasably engaged, as described above, through the operable interaction of locking pin 112 and latch 120. This process repeats until cover panel deployment is completed.

Figure 7:
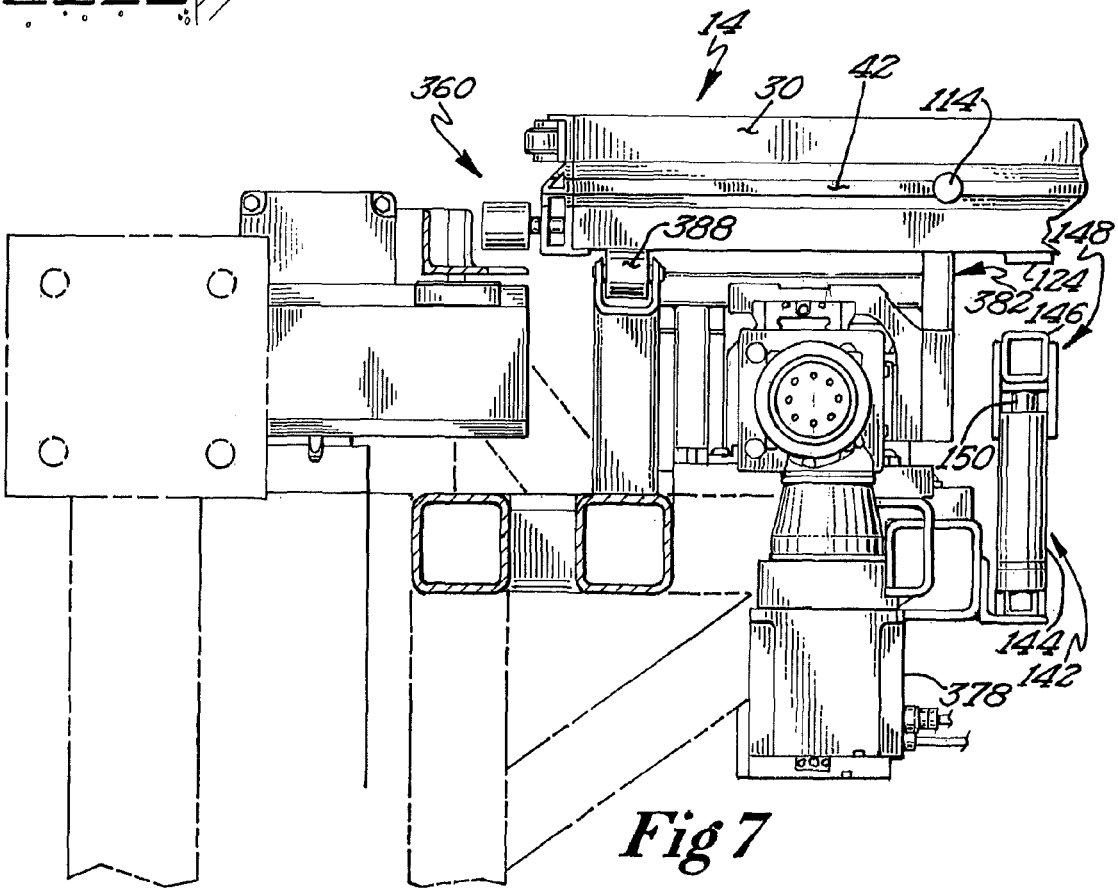
FIG. 7 is a schematic diagram of a storage apparatus of the retractable cover apparatus of the present invention.
Figure 8:
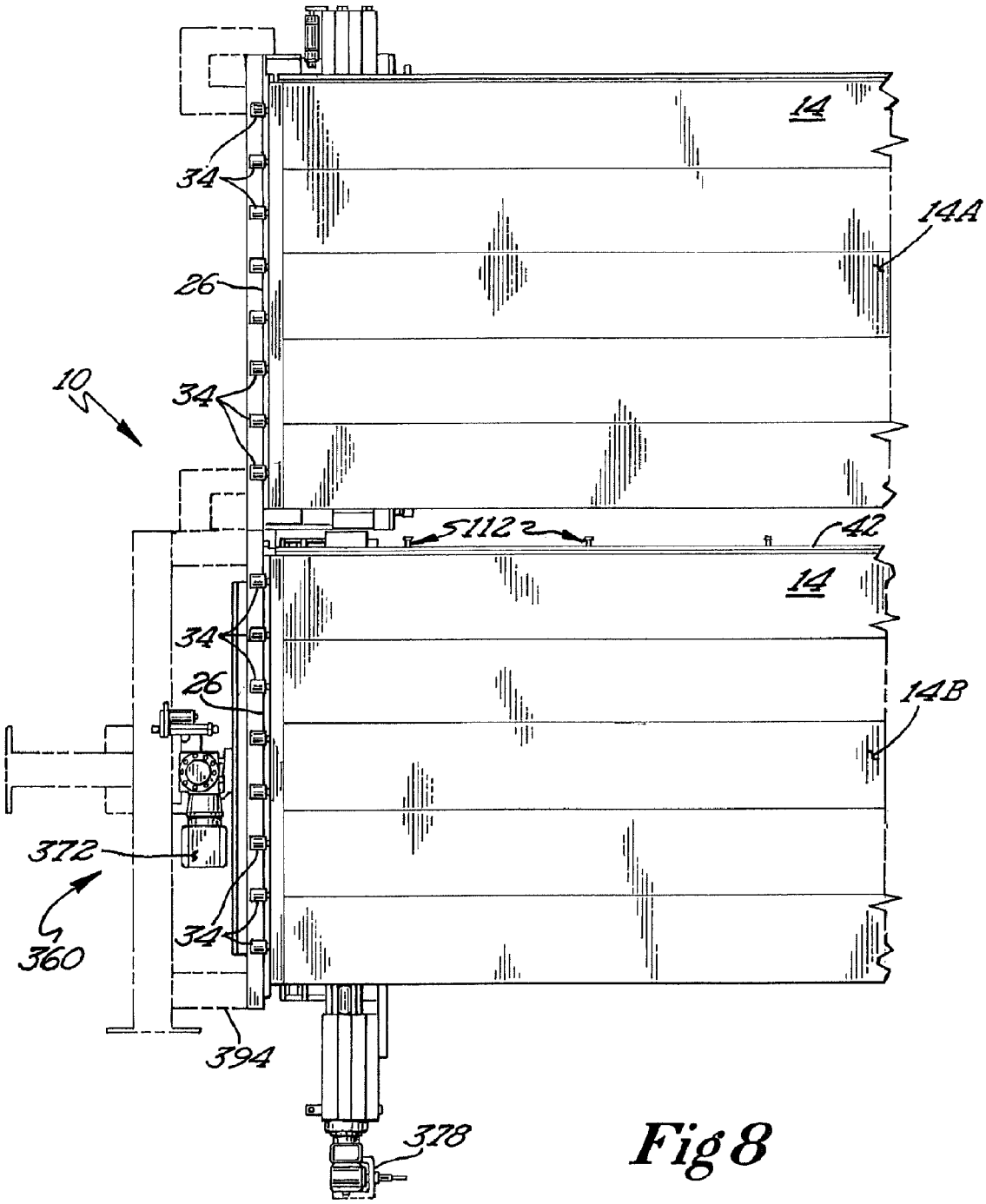
FIG. 8 is a top view of a storage system of the retractable cover apparatus of the present invention.
Figure 9:
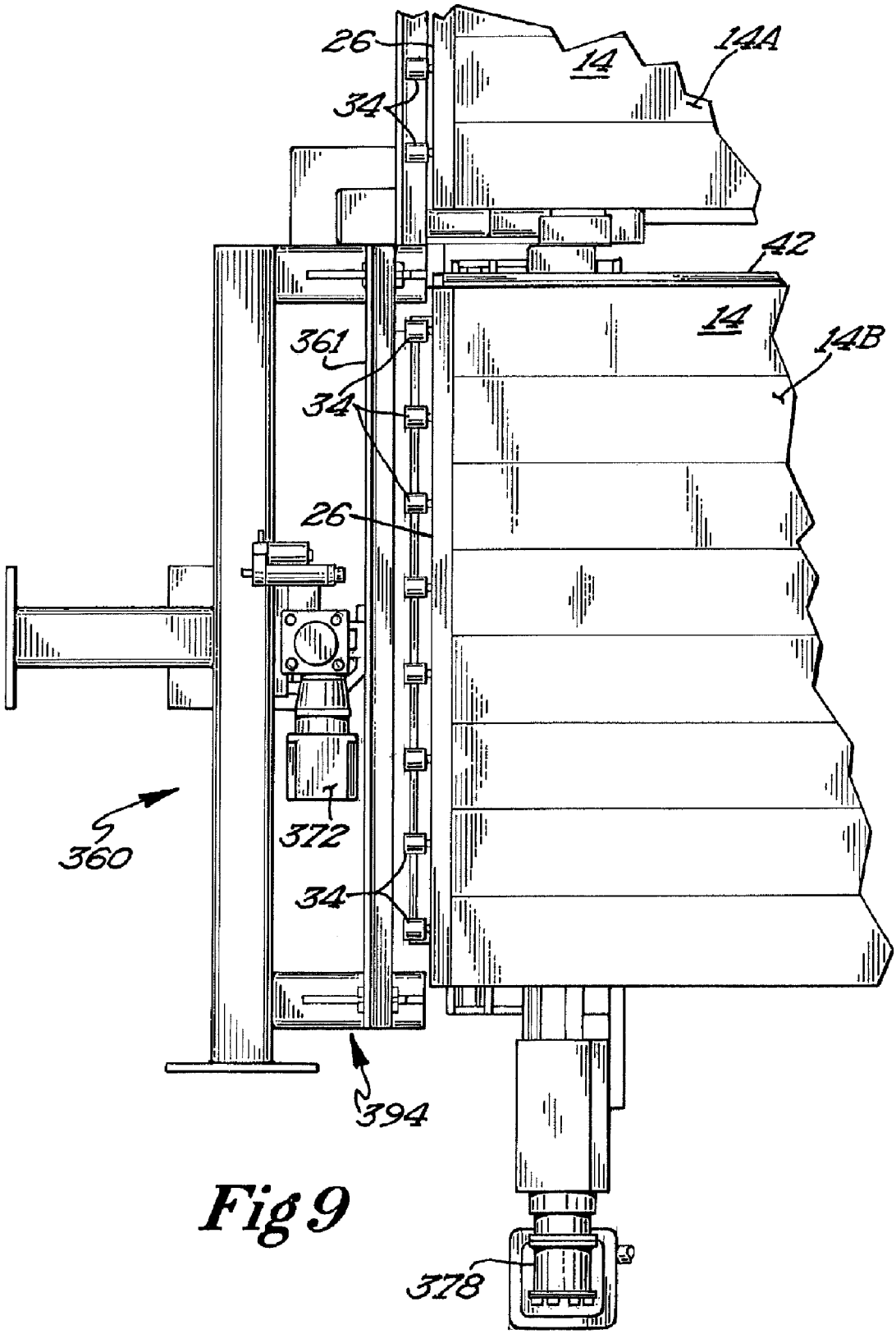
FIG. 9 is an enlarged view of a portion of the storage apparatus illustrated in FIG. 8 with a support angle being laterally moved.

In another embodiment, illustrated in FIGS. 7-10, retractable cover apparatus 10 may include a storage system 360 which includes first and second storage stations 394, 396 which together define a plurality of substantially vertically-arrayed storage bins 380, each configured for operably receiving a horizontally-oriented cover panel 14. As illustrated in FIG. 7, storage system 360 includes a docking tray 382 that is selectively drivable along a vertical axis substantially perpendicular to track 16. In one embodiment, docking tray 382 may be selectively drivable along axis 384 at and below docking station 398. Docking tray 382 may be defined among two support elements 386, each positioned at a respective storage station 394, 396, wherein such support elements 386 are configured for operably supporting a cover panel 14 while docking tray 382 is operably driven along docking path 384. In one embodiment, support elements 386 may include a plurality of rollers 388 which facilitate the loading and unloading of cover panels 14 thereto.

Figure 10A:
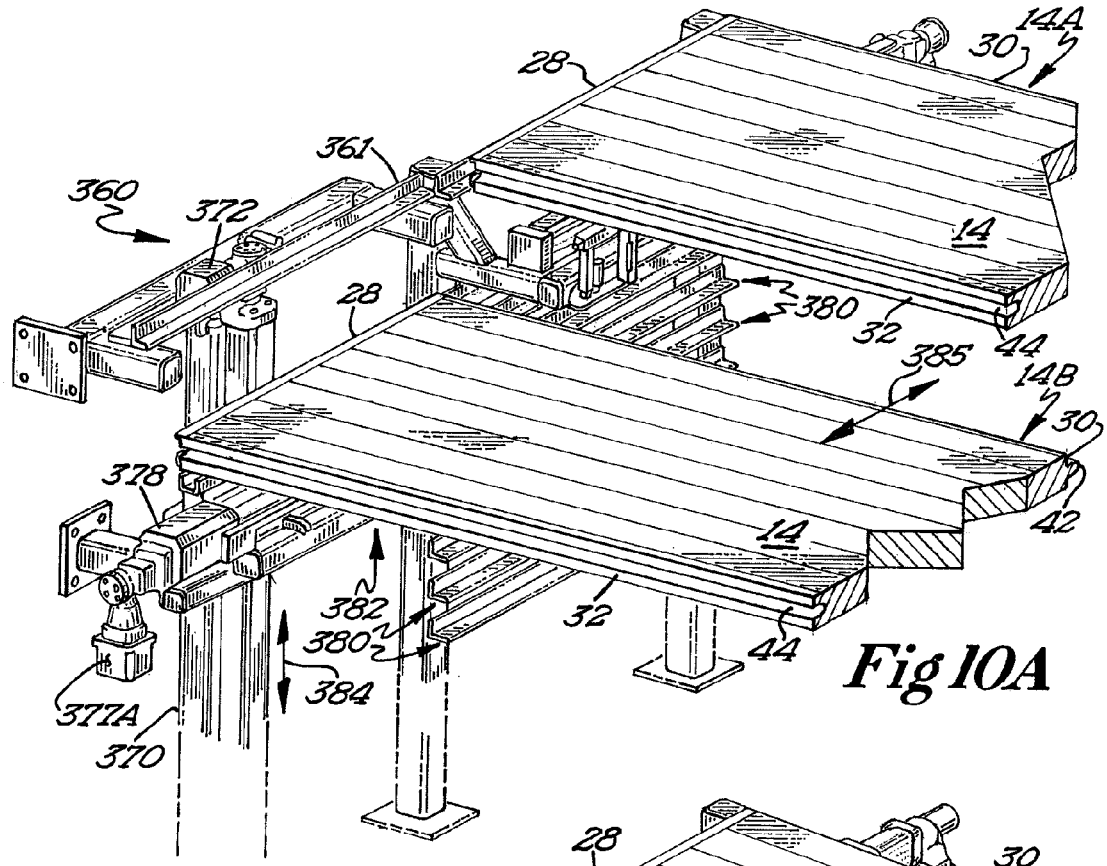
FIG. 10A is a perspective view of a portion of the storage system illustrated in FIGS. 8 and 9.
Figure 10B:
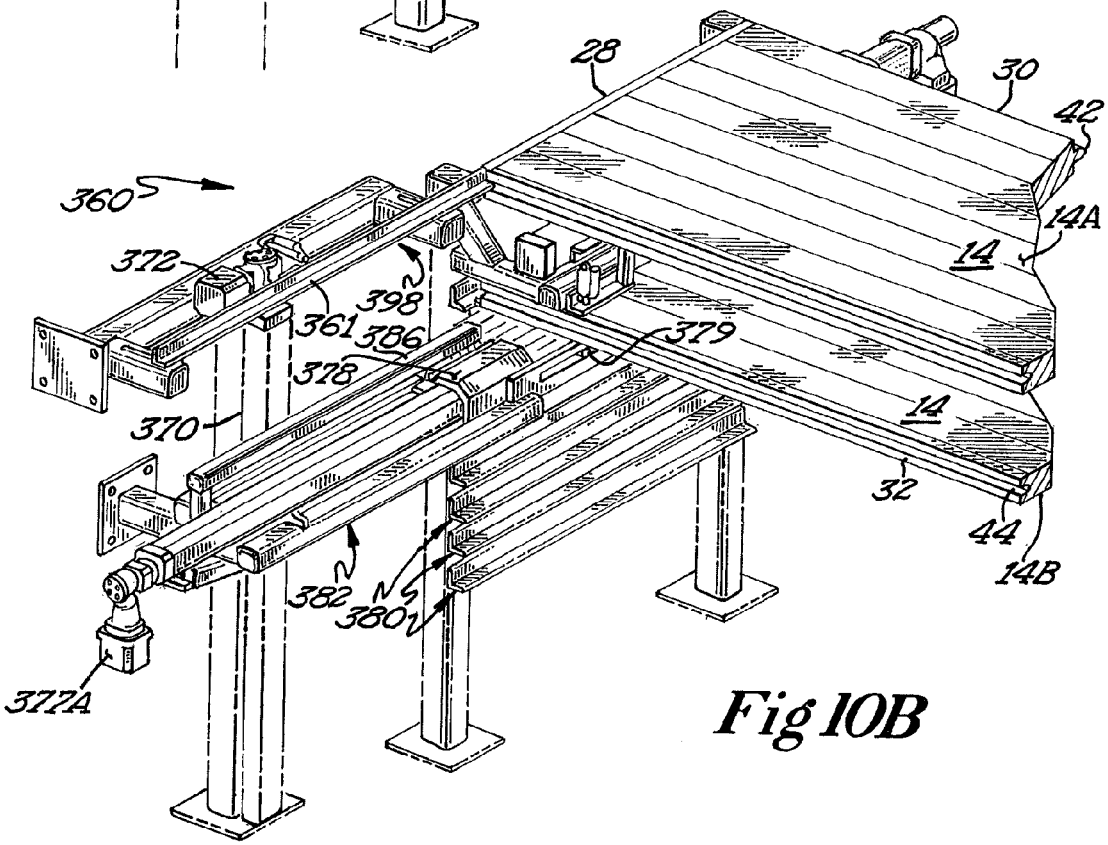
FIG. 10B is a further perspective view of a portion of the storage system of the retractable cover apparatus illustrated in FIGS. 8 and 9.

As illustrated in FIGS. 10A and 10B, docking tray 382 may be coupled to a lift screw drives 370 aligned along docking path 384. Lift screw drive 370 may be motivated by a lift motor 372, which actuates lift screw drive 370 to selectively drive docking tray 382 along docking path 384. In one embodiment, lift screw drive 370 drives support elements 386 of docking tray 382 along docking path 384, which is in proximity to first and second storage stations 394, 396. Lift motor 372 may be a stepper motor controllable to produce measured moves of lift screw drive 370, such that docking tray 382 may be selectively movable along docking path 384 into selected docking locations in alignment with respective storage bins 380.

Storage system 360 may further include a stowage drive 378 that is coupled to docking tray 382, and is adapted for selectively moving a cover panel 14 supported by docking tray 382 along respective stowage paths defined as extending from support elements 386 to storage bins 380.

An example embodiment of stowage system 360 may operate as follows. A first cover panel 14A is retracted along track 16 by first drive motors 72A, 72B, as described above, to a transition location which may be defined as the end of travel of coupling units 81A, 81B toward second terminus point 8. Coupling units 81A, 81B are then disengaged from first cover panel 14A and advanced along first and second screw drives 80A, 80B to subsequently engage a subsequent cover panel 14B. Stowage drive 378 advances a retention pin 379 underneath first cover panel 14A along a direction parallel to the path of travel of cover 18 along track 16. Stowage drive 378 may advance retention pin 379 by a measured move of stowage motors 377A, 377B. As in the movements described above, the measured move of retention pin 379 may be confirmed through proximity sensors communicatively coupled to the control system. Once in an appropriate position, lift screw drive 370 moves docking tray 382 up along docking path 384 and into engagement with lower surface 224 of cover panel 14A. Such engagement places support elements 386 in contact with lower surface 224 of cover panel 14A, and further engages retention pin 379 in receptacle 17 thereof. As in the method described above, the control system actuates latch release mechanism 142 to press upon latch keyhole plate 124 so as to enable disengagement or first cover panel 14A from second cover panel 14B. Storage motors 377A, 377B are then activated to reverse the direction of stowage drive 378, and to retract first cover panel 14A toward second terminus point 8. Such movement disengages first cover panel 14A from second cover panel 14B, and also begins loading first cover panel 14A on support elements 386 of docking tray 382. Stowage drive 378 retracts first cover panel 14A to a docking station 398, at which point support angle 361 is moved laterally out from alignment with track 16 while docking tray 382 fully supports first cover panel 14A. By moving support angles 361 out from alignment with track 16, docking tray 382 is able to be lowered along docking path 384 without interference between first cover panel 14A and support angles 361.

Lift screw drive 370 is then actuated to lower docking tray 382 to a desired docking location in alignment with a first storage bin 380A. Such movement may be accomplished by a measured move, and confirmed by proximity sensors, as described above. Once at the desired docking location, stowage drive 378 is again activated to horizontally move first cover panel 14A along stowage path 385 into supportive engagement at storage bin 380A. At this juncture, lift screw drive 370 is again actuated to further lower docking tray 382 along docking path 384 in order to disengage retention pin 79 from receptacle 17 in first cover panel 14A. Stowage drive 378 retracts retention pin 379 back from under first cover panel 14A, and lift screw drive 370 lifts docking tray 382 up along docking path 384 to repeat the process described above for second cover panel 14B. Such process is repeated until the desired number of cover panels are operably placed into respective storage bins 380.

In order to deploy cover panels 14 out along track 16, the storage process described above is reversed, wherein cover panels are retrieved from their respective storage bins 380, and lifted up to docking station 398 for subsequent deployment out along track 16 toward first terminus point 6. Engagement between respective adjacent cover panels 14 is accomplished through the locking pin and latch mechanisms described above.

Though a particular arrangement of drive motors and sensors has been described above, it is contemplated that a variety of other drive, sensor, and control arrangements may be effectively utilized in the deployment, retrieval, and storage operations of drive apparatus 12. As such, the embodiment described above is not intended to be limiting as to the mechanism by which cover panels 14 are driven either along directions 52 or directions 54.

Loading Test Results

Example cover panels of the present invention were tested for performance under load in accordance with the procedures outlined in ASTM E 72-05 "Standard Test Methods for Conducting Strength Tests of Panels for Building and Construction" and ICC-ES AC04 "Acceptance Criteria for Sandwich Panels". A summary of the test procedures is as follows:

1. The panel samples were placed in a horizontal position under a reaction frame, and was supported at the ends by a 1.5 inch steel plate and placed on a continuous 1.75 inch diameter pipe oriented longitudinally with respect to the panel width.

2. A uniform load was applied to each sample using an inflatable dunnage airbag system. The airbag was placed between the sample panel and the reaction frame.

3. The dunnage bag was inflated using a compressed air source, with the pressure measured with a mercury manometer read to the nearest 0.01 inch/Hg.

4. Three digital string transducers were used to monitor the deflection of the sample panels during the test. The three transducers were located at the mid-span of the panel sample, one at each outside edge and one in the center of the panel.

5. Load was applied in uniform increments and deflection readings were recorded before and after a five minute period under constant uniform load. The load was released and the procedure was repeated at the next incremental increase, up to 110 pounds per square foot loading. No structural failure was noted in the sample panel.

Figure 11:
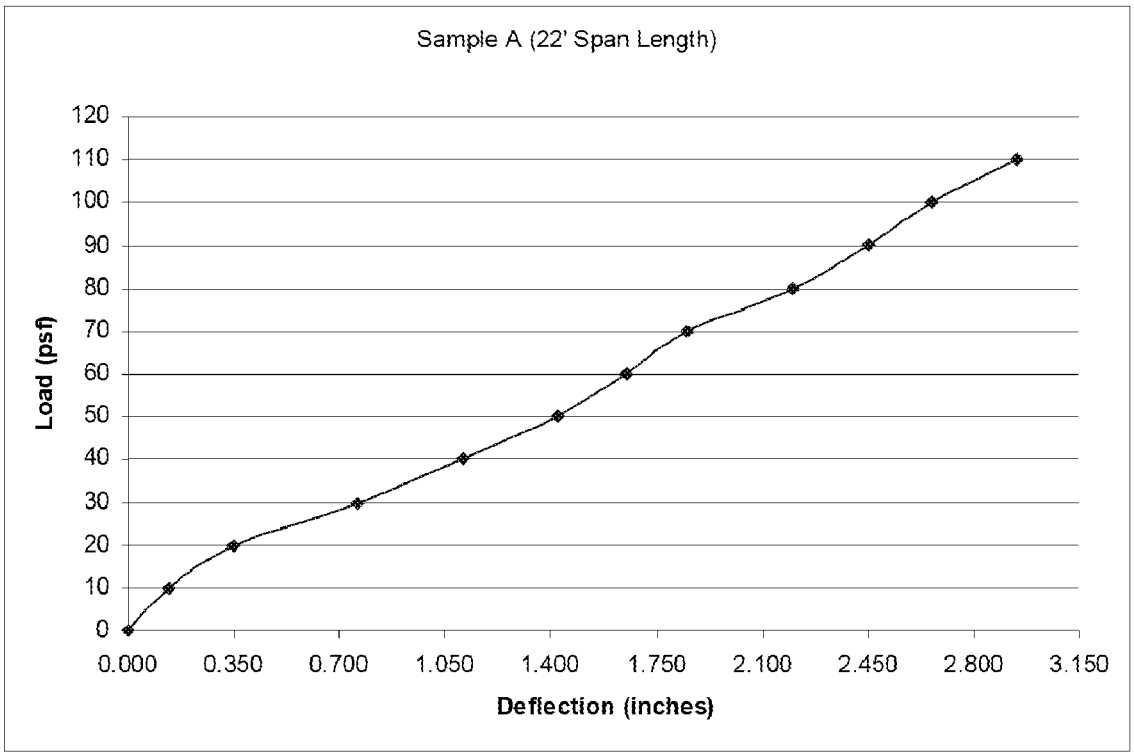
FIG. 11 is a chart showing deflection under loading.
Figure 12:
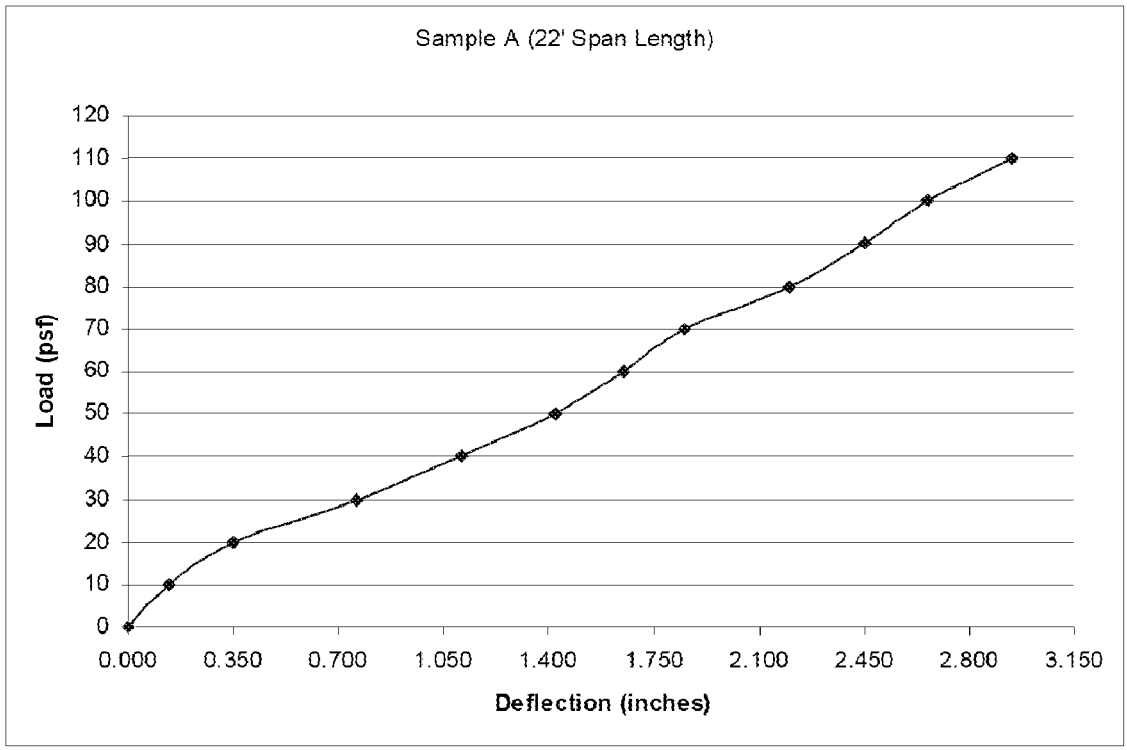
FIG. 12 is a chart showing deflection under loading.

6. The charts illustrated in FIGS. 11 and 12 reflect the average deflection in inches under various loadings for two panel samples tested. Cover panel sample A was tested at a 22 foot span length, while cover panel sample B was tested at a 17 foot span length. No structural failure was observed in either sample cover panels under loads up to 110 pounds per square foot. Accordingly, the sample cover panels are believed to be "load-bearing" at least to an extent of 110 pounds per square foot.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different methods/devices and that various modifications can be accomplished without departing from the scope of the invention itself.

What is claimed is:

1. A retractable load-bearing cover apparatus, comprising:

a track defining a path of travel between first and second terminus points;

a plurality of sections deployable along said track in a first direction towards a first terminus point, and retractable along said track in a second direction opposite said first direction and toward said second terminus point, adjacent ones of said sections being releasably engageable to one another;

a drive system for deploying and retracting said sections along said track; and a storage system for disengaging releasably engaged sections from one another and arranging said disengaged sections into a vertically stacked orientation, with said sections defining respective planes disposed substantially horizontally and in parallel with one another, said storage system including first and second carousels each having a rack including a plurality of stanchions for supporting said sections, said rack being drivable along a storage path, at least a portion of which is substantially perpendicular to said path of travel.

2. A retractable load-bearing cover apparatus as in claim 1 wherein said track includes first and second channels engagable with respective support structures coupled to said sections.

3. A retractable load-bearing cover apparatus as in claim 2 wherein said support structures are disposed at first and second opposed ends of said sections.

4. A retractable load-bearing cover apparatus as in claim 3 wherein said support structures are rotatable bushings.

5. A retractable load-bearing cover apparatus as in claim 2 wherein said track is embedded in a wall.

6. A retractable load-bearing cover apparatus as in claim 1, including latches disposed at respective rear sides of said sections, and locking pins extending from respective front sides of said sections to together form a plurality of locking sets at facing front and rear surfaces of respective adjacent sections, wherein said latches include an aperture in said rear side and a latch keyhole plate that is biasably urged into locking engagement with said respective locking pin when said respective locking pin is inserted into said aperture to an extent sufficient to disengage a biased retaining pin from engagement with said latch keyhole plate, and wherein said latch keyhole plate is disengagable from said locking pin to disengage said locking pin from said latch.

7. A retractable load-bearing cover apparatus as in claim 1 wherein said drive system includes first and second screw drive units.

8. A retractable load-bearing cover apparatus as in claim 7, including coupling units driven by said first and second screw drive units so as to be movable in said first and second directions along said path of travel, each of said coupling units having actuatable pins that are selectively drivable into receptacles at said sections, said pins being selectively drivable along an axis that is substantially perpendicular to said path of travel to thereby couple to respective sections at said receptacles such that driven movement of said first and second screw drive units is capable of correspondingly moving said respective sections along said path of travel.

9. A retractable load-bearing cover apparatus as in claim 8 wherein said screw drive units comprise stepper motors controllable to produce measured moves of said coupling units along said path of travel.

10. A retractable load-bearing cover apparatus as in claim 1, including a storage drive mechanism for driving said racks along said storage paths, said drive mechanism including a stepper motor controllable to produce measured moves of said racks along said storage paths.

11. A retractable load-bearing cover apparatus as in claim 10 wherein said racks disposed at respective sets of said stanchions are simultaneously movable along said storage paths, and are positionable at respective first storage locations along said storage paths wherein said stanchions are arrayed in a substantially vertically stacked orientation.

12. A retractable load-bearing cover apparatus as in claim 11 wherein respective sets of said stanchions are selectively positionable at a docking location of said storage paths, wherein said sections may be loaded to and unloaded from said stanchion sets.

13. A retractable load-bearing cover apparatus as in claim 12 wherein said docking location is along said path of travel.

14. A retractable load-bearing cover apparatus as in claim 1 wherein said sections are load-bearing, and are capable of withstanding loads of 100 pounds per square foot without structural damage thereto.

15. A retractable load-bearing cover apparatus as in claim 14 wherein said sections each comprise a plurality of nested C-beams.

16. A retractable load-bearing cover apparatus as in claim 14 wherein said sections are selectively tensional along respective length axis thereof.

* * * * *